US008281848B2

(12) United States Patent
Park

(10) Patent No.: US 8,281,848 B2
(45) Date of Patent: Oct. 9, 2012

(54) SPRING MOUNTING FEATURE FOR HEAT EXCHANGER

(75) Inventor: Sang Bae Park, Northville, MI (US)

(73) Assignee: DENSO International America, Inc., Southfield, MI (US)

( * ) Notice: Subject to any disclaimer, the term of this patent is extended or adjusted under 35 U.S.C. 154(b) by 1017 days.

(21) Appl. No.: 12/008,968

(22) Filed: Jan. 15, 2008

(65) Prior Publication Data

US 2009/0178781 A1 Jul. 16, 2009

(51) Int. Cl.
*F28F 9/007* (2006.01)

(52) U.S. Cl. ..... 165/67; 165/42; 165/81; 180/68.4

(58) Field of Classification Search ..... 165/41, 165/42, 67, 76, 77, 81; 180/68.4; 24/297, 24/614, 615, 618
See application file for complete search history.

(56) References Cited

U.S. PATENT DOCUMENTS 1,590,400 A * 6/1926 Widmer ..... 292/80
4,534,407 A * 8/1985 Lardner ..... 165/81
4,750,781 A * 6/1988 Betteridge ..... 296/214
5,484,014 A * 1/1996 Maier ..... 165/159
6,199,622 B1 * 3/2001 Mashio et al. ..... 165/67
6,237,676 B1 5/2001 Hasegawa et al.
6,527,044 B2 * 3/2003 Mangold ..... 165/67
6,615,604 B2 * 9/2003 Neufang ..... 62/298
6,684,466 B2 * 2/2004 Nishida et al. ..... 24/615
6,705,387 B2 3/2004 Kokubunji et al.
2007/0144713 A1 * 6/2007 Sugimoto et al. ..... 165/140

* cited by examiner

*Primary Examiner* — Teresa Walberg
(74) *Attorney, Agent, or Firm* — Harness, Dickey & Pierce, PLC

(57) ABSTRACT

A heat exchanger assembly includes a first heat exchanger having a pair of mounts attached to one of the tanks of the first heat exchanger and a second heat exchanger having a pair of brackets attached to one of the tanks of the second heat exchanger. The brackets are freely insertable into the mounts when the two heat exchangers are at an acute angle with respect to each other. When the two heat exchangers are parallel with each other, an interference condition exists between the brackets and the mounts. The opposite side of the heat exchangers is secured using a retainer on one heat exchanger extending through a strap on the other heat exchanger.

19 Claims, 4 Drawing Sheets

SPRING MOUNTING FEATURE FOR HEAT EXCHANGER

FIELD

The present disclosure relates to mounting systems for components of an automotive air conditioning system. More particularly, the present invention relates to a mounting system for securing a condenser of the vehicle's air conditioning system to a radiator of the vehicle's cooling system.

BACKGROUND

The statements in this section merely provide background information related to the present disclosure and may not constitute prior art.

Automobile vehicles typically include a first heat exchanger which can be a radiator which is part of the vehicle's engine cooling system and a second heat exchanger which can be a condenser which is a part of the vehicle's air conditioning system. The radiator has engine coolant running through a plurality of tubes and this engine coolant is cooled by exchanging heat with ambient air flowing through the heat exchanger or radiator. The condenser has a refrigerant running through a plurality of tubes and this refrigerant is cooled by exchanging heat with air flowing though the heat exchanger or condenser.

Both the radiator and the condenser are typically located at the front of the vehicle behind a front grill. Because of the cooling requirements of the engine coolant and the refrigerant, the condenser is usually positioned down stream from the radiator in an air flow direction through the radiator and condenser.

When mounting the radiator and condenser to the vehicle, various systems can be utilized. Both the radiator and the condenser can be attached to a front cross member separately or one of these components can be attached to a front cross member with the other component being attached to the component attached to the front cross member.

Regardless of the attachment system utilized, the attachment system must provide secure attachment of the components, simplicity of assembling of the components and the attachment system must be durable and trouble free during the life of the vehicle.

SUMMARY

The present disclosure provides an attachment system for attaching a first heat exchanger to a second heat exchanger. The first heat exchanger includes a pair of mounts attached to one first heat exchanger tank each of which accepts a bracket attached to one second heat exchanger tank of the second heat exchanger. The bracket is designed with a press fit relationship in relation to the mount. The first heat exchanger also includes a pair of threaded fasteners attached to the opposite first heat exchanger tank. The second heat exchanger includes a pair of mounting straps attached to the opposite second heat exchanger tank. The brackets are inserted into their respective mount until a bolt hole in each mounting strap aligns with the threaded fastener. A bolt for a female fastener or a nut for a male fastener is attached to the threaded fastener to complete the assembly. The press fit design of the bracket and mount eliminate any rattling concern between the two components and the attachment system provides a simple low cost method of attachment for the two components. In addition, this mounting system allows each heat exchanger to freely slide (or expand) and thus release thermal stress.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
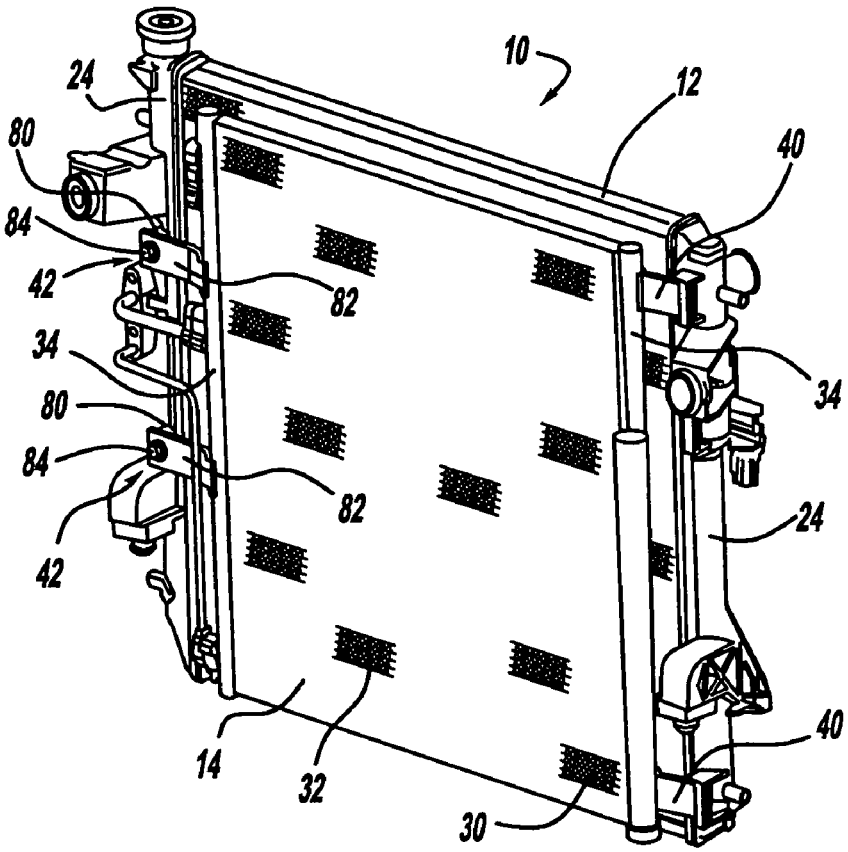
FIG. 1 is a rear perspective view of a first heat exchanger and a second heat exchanger in accordance with the present disclosure.
Figure 2:
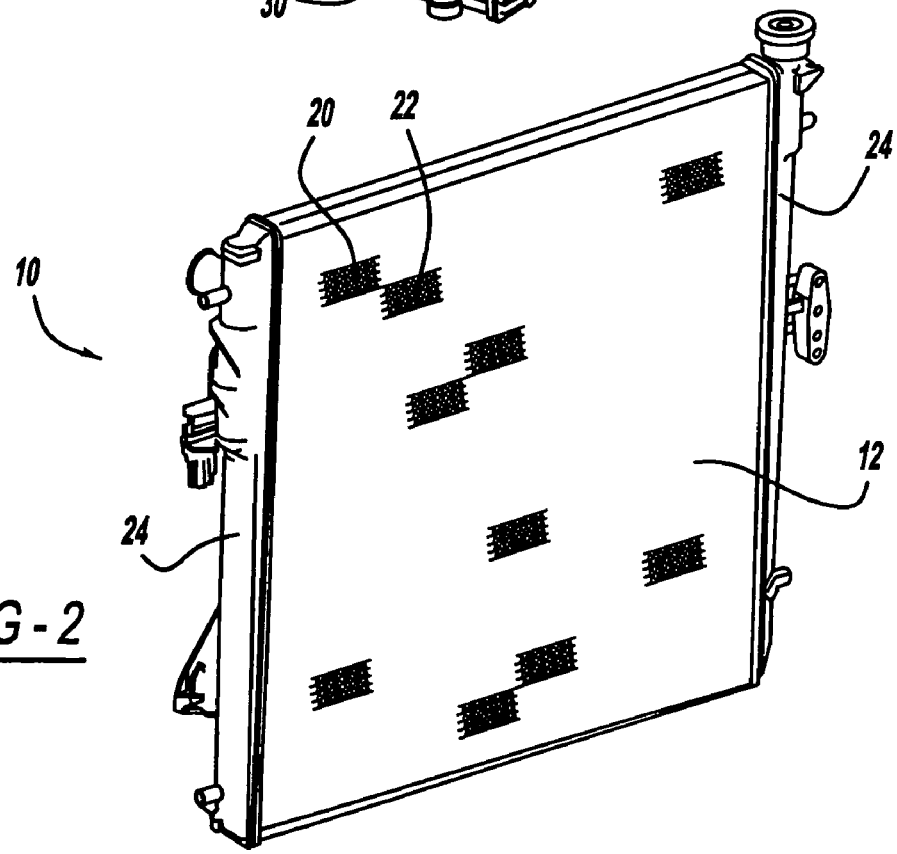
FIG. 2 is a front perspective of the first heat exchanger and the second heat exchanger illustrated in FIG. 1.

There is illustrated in FIGS. 1 and 2 a heat exchanger assembly 10 in accordance with the present disclosure. Heat exchanger assembly 10 comprises a first heat exchanger 12 and a second heat exchanger 14. As illustrated in FIGS. 1 and 2, first heat exchanger 12 is a radiator and second heat exchanger 14 is a condenser. It is to be understood that the present invention is not limited to a radiator and condenser and that any two heat exchangers can be attached with the mounting system of the present disclosure.

First heat exchanger 12 comprises a plurality of aluminum tubes (first tubes) 20 through which a first flow and a plurality of aluminum fins 22 having a corrugated shape and which are bonded to an outer surface of tubes 20 for enhancing the heat exchanger between the first fluid and air. A first header tank 24 is disposed at longitudinal opposite ends of the plurality of tubes 20 and the plurality of fins 22. The first fluid flows from a device into one of the first header tanks 24, through the plurality of tubes 20, into the opposite first header tank 24 and then back to the device being cooled as is known in the art. One or more baffles (not shown) can be included within first header tanks 24 to create a multi-directional flow first heat exchanger as is well known in the art.

Second heat exchanger 14 comprises a plurality of aluminum tubes (second tubes) 30 through which a second fluid flows and a plurality of aluminum fins 32 having a corrugated shape and which are bonded to an outer surface of tubes 30 for enhancing the heat exchange between the second fluid and air. A second header tank 34 is disposed at longitudinal opposite ends of the plurality of tubes 30 and the plurality of fins 32. The second fluid flows from a device into one of the second header tanks 34; through the plurality of tubes 30; into the opposite second header tank 34 and then towards the device as is known in the art. One or more baffles (not shown) can be included within second header tanks 34 to create a multi-directional flow second heat exchanger as is well known in the art.

As is illustrated in FIGS. 1 and 2, second heat exchanger 14 is attached to first heat exchanger 12 and the assembly of first heat exchanger 12 and second heat exchanger 14 can be installed in the vehicle. Typically, first heat exchanger 12 is located in front of second heat exchanger 14 such that air flow from the front of the vehicle first passes through first heat exchanger 12 and then passes through second heat exchanger 14. The attachment of second heat exchanger 14 to first heat exchanger 12 is accomplished using a pair of mounting bracket assemblies 40 and a pair of attachment assemblies 42.

Figure 3:
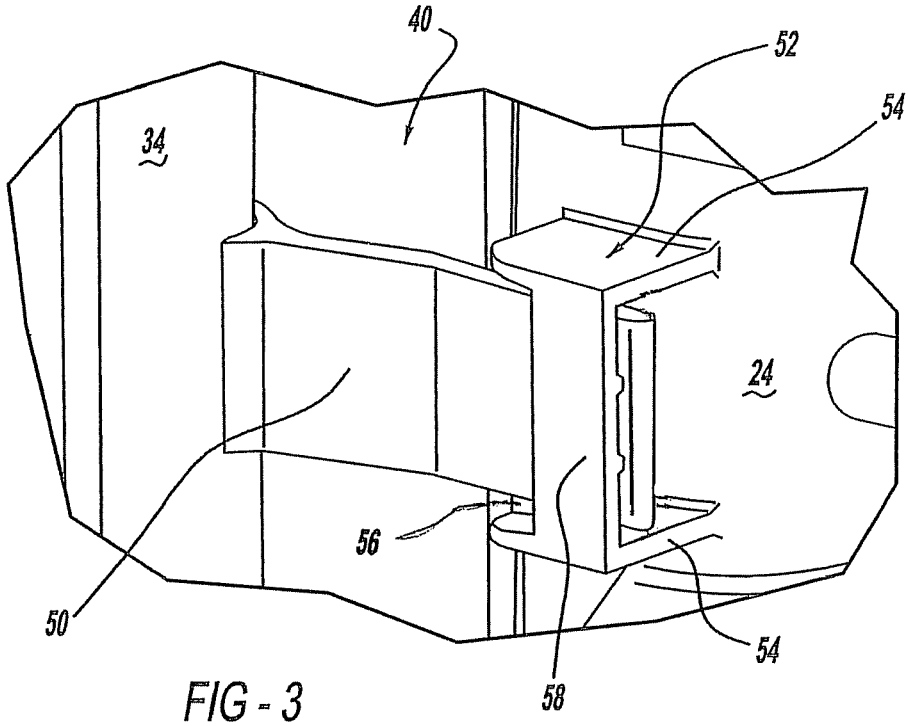
FIG. 3 is an enlarged view of one of the brackets and mounts illustrated in FIG. 2.

Referring now to FIG. 3, a mounting bracket assembly 40 is illustrated. Each mounting bracket assembly 40 is the same and thus the description below is applicable to either of the pair of mounting bracket assemblies 40. Mounting bracket assembly 40 comprises a bracket 50 and a mount 52.

Figure 4:
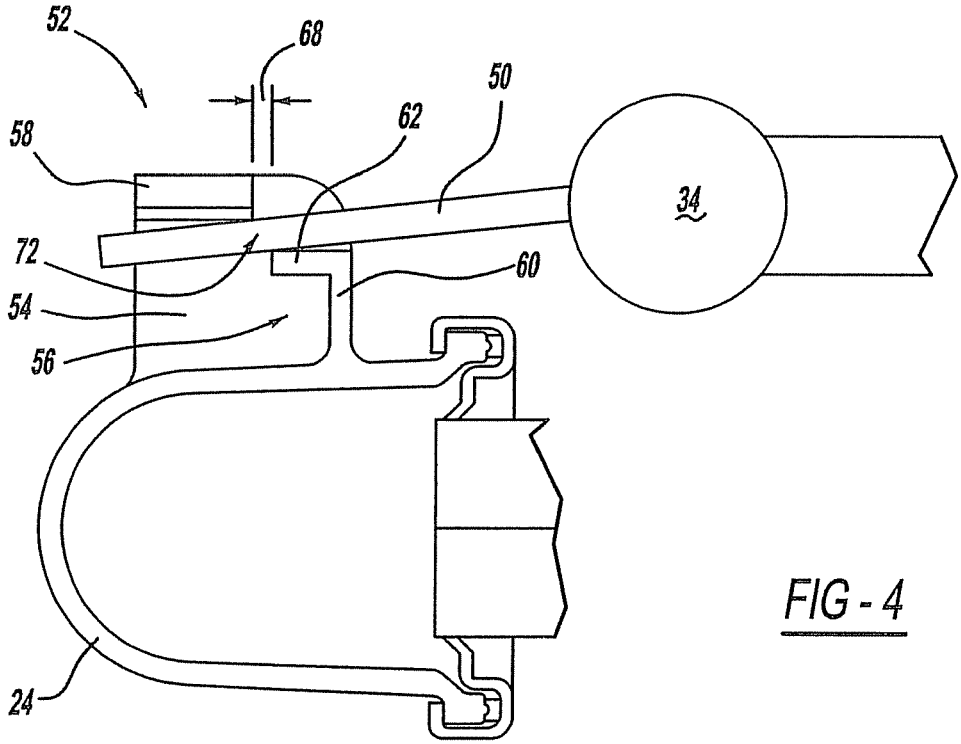
FIG. 4 is an upper view partially in cross-section of the bracket and mount illustrated in FIG. 3 during the assembly of the bracket to the mount.
Figure 5:
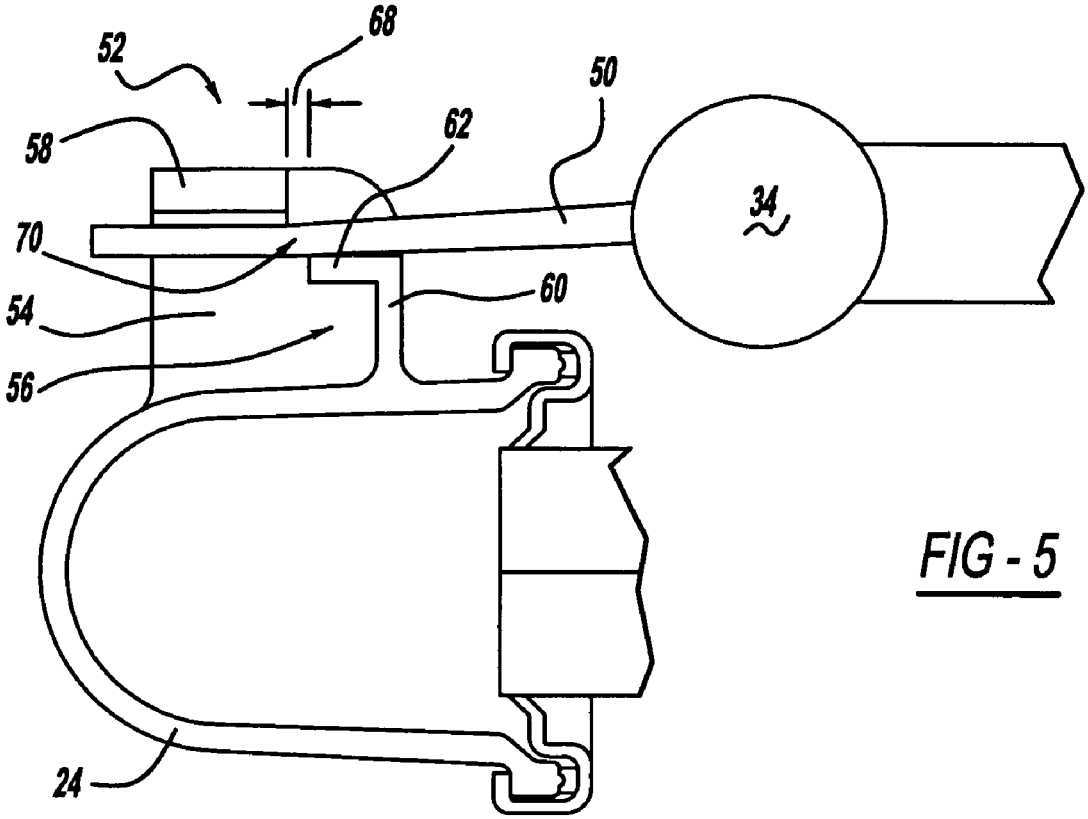
FIG. 5 is an upper view similar to FIG. 4 but after the assembly of the second heat exchanger to the first heat exchanger has been complete.

Referring now to FIGS. 3-5, bracket 50 is a generally rectangular shaped component which is attached to or integral with one of the pair of second header tanks 34. Bracket 50 is designed to be inserted into a respective mount 52 as discussed below.

Figure 6:
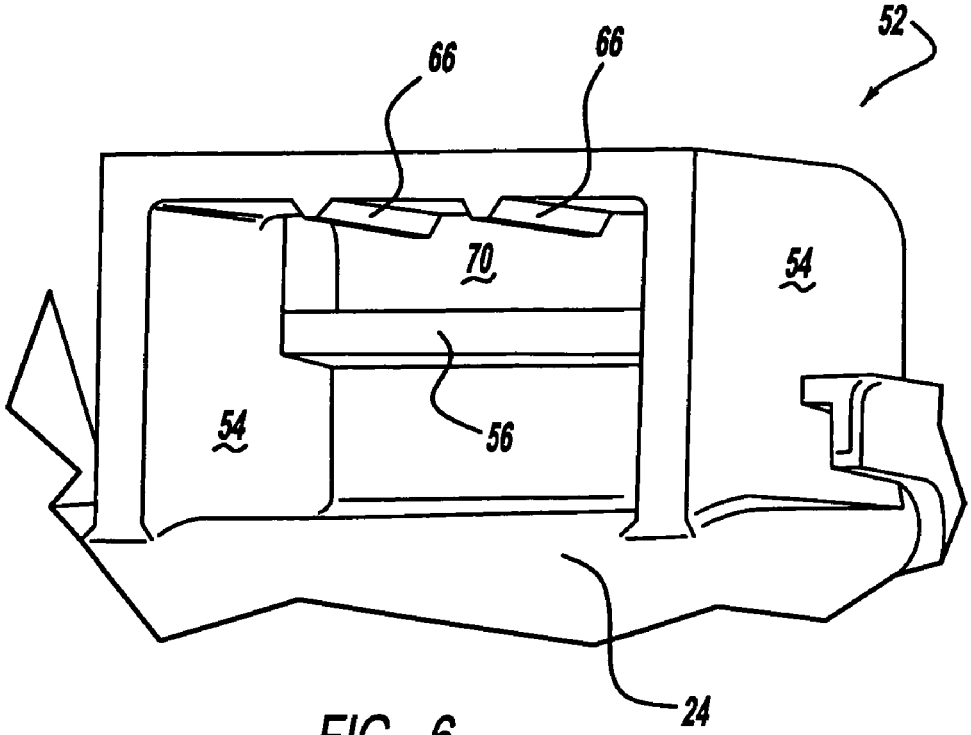
FIG. 6 is a perspective view of the mount in accordance with the present disclosure.
Figure 7:
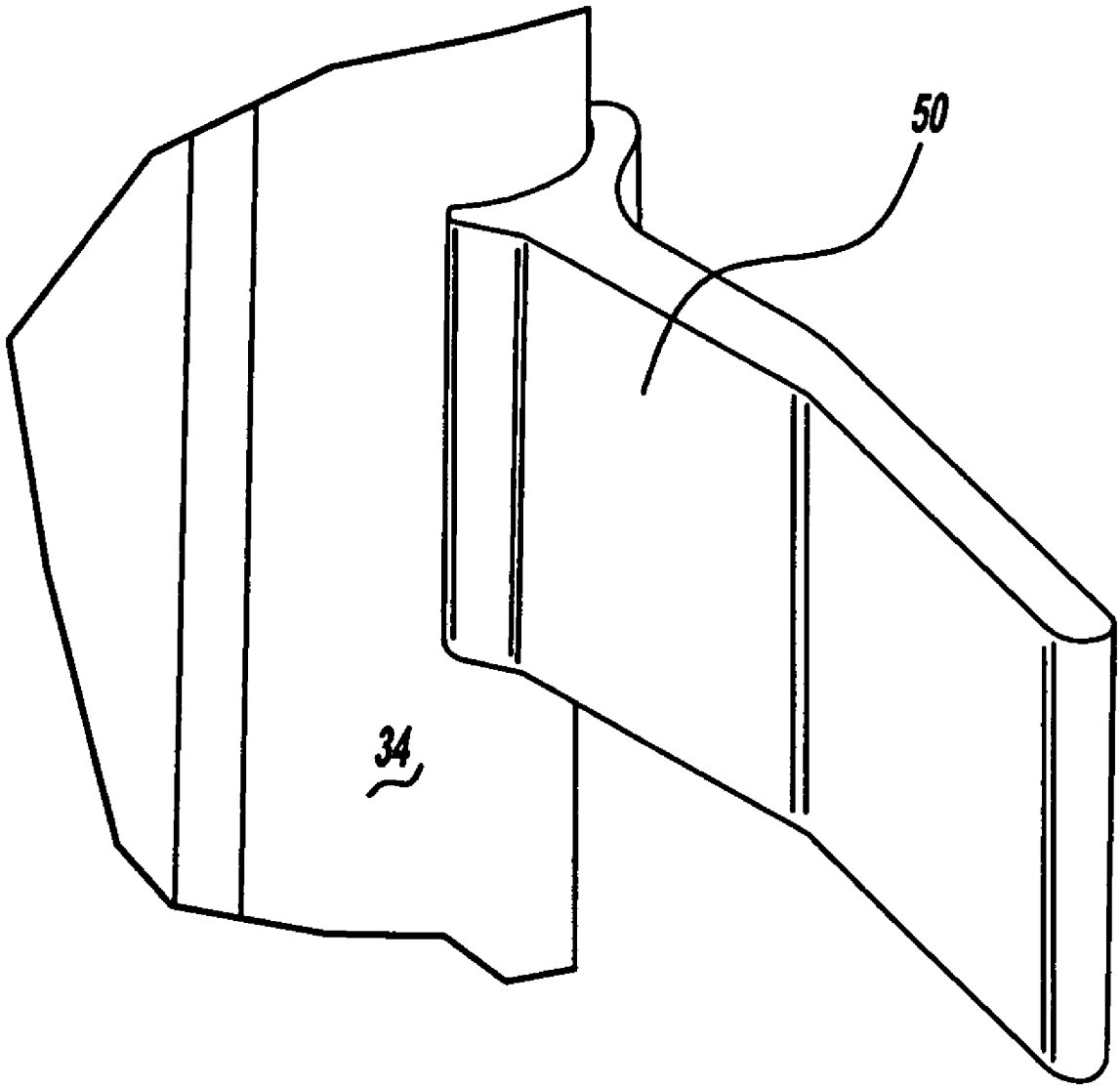
FIG. 7 is a perspective view of the bracket in accordance with the present disclosure.

Referring now to FIGS. 3-6, mount 52 is attached to or integral with one of the pair of first header tanks 24. Mount 52 is a generally rectangular mount which includes a pair of uprights 54 extending generally perpendicular to first header tank 24, a lower retaining wall 56 extending between the pair of uprights 54 and an upper retaining wall 58 also extending between uprights 54. Lower retaining wall 56 is an L-shaped wall having an upright portion 60 extending generally perpendicular to radiator tank extending between uprights 54 and a retaining portion 62 which extends generally perpendicular to upright portion 60 and also extends between uprights 54. Upper retaining wall 58 is generally parallel to retaining portion 62 and upper retaining wall 58 defines a plurality of ribs 66 extending over the entire width of upper retaining wall 58. As illustrated in FIG. 6, each rib 66 has a trapezoidal cross-section. The present disclosure illustrates a trapezoidal shape for ribs 66 but other shapes including but not limited to triangular or half-moon shape could be used.

As illustrated in FIGS. 4 and 5, there is no overlap between retaining portion 62 of lower retaining wall 56 and upper retaining wall 58 in the width direction of uprights 54 and no overlap between retaining portion 62 of lower retaining wall 56 and upper retaining wall 58 in the height direction of uprights 54. The widths of retaining portion 62 of lower retaining wall 56 and upper retaining wall 58 are designed such that a gap 68 exists between retaining portion 62 and upper retaining wall 58 of mount 52. The height of lower retaining wall 56 and position of upper retaining wall 58 are designed such that an opening 70 exists between retaining portion 62 and upper retaining wall 58 of mount 52. Opening 70 receives bracket 50 as detailed below. Gap 68 and opening 70 create an insertion slot 72 which accepts bracket 50 as illustrated in FIG. 4. By slightly tilting second heat exchanger 14 at an acute angle with respect to first heat exchanger 12 and thus bracket 50, bracket 50 can be easily inserted into slot 72 and once inserted, second heat exchanger 14 can be moved into its installed position as illustrated in FIG. 5 generally parallel with first heat exchanger 12 to create an interference fit between bracket 50 and retaining portion 62 and upper retaining wall 58 of mount 52.

The pair of attachment assemblies 42 each includes a threaded retainer 80 attached to or integral with the first header tank 24 which is opposite to the first header tank 24 that incorporates mount 52 and an attachment strap 82 which defines a hole for accepting a bolt 84 or a different fastener known in the art. While attachment assembly 42 is illustrated as having a female threaded retainer 80 accepting a bolt 84 extending through the hole defined by strap 82, it is within the scope of the present disclosure to utilize other fastening systems for attachment assembly 42 including but not limited to a male fastener extending through the hole defined by strap 82 and secured by a nut or any other fastening systems known in the art.

The attachment of second heat exchanger 14 to first heat exchanger 12 begins by tilting second heat exchanger 14 at an acute angle with respect to first heat exchanger 12 and aligning the pair of brackets 50 with their respective slot 72 defined by mount 52. Brackets 50 are then freely inserted into their respective slot 72 and second heat exchanger 14 is rotated to its installed position generally parallel with first heat exchanger 12 and the holes in straps 82 are aligned with their threaded holes in female threaded retainer 80. Bolts 84 are then assembled into female threaded retainers 80 and torqued to the required tightness to complete the assembly. As illustrated in FIG. 4, due to gap 68 and opening 70 between retaining portion 62 and upper retaining wall 58 of mounts 52, bracket 50 is freely inserted into slot 72 and once second heat exchanger 14 is rotated to its installed position, an interference fit exists between retaining portion 62 and upper retaining wall 58 of mount 52 and bracket 50. This interference fit can be designed into mounting bracket assembly such that the interference fit is created regardless of the tolerance stack up between bracket 50 and mount 52. After installation, the sliding fit between bracket 50 and mount 52 allows second heat exchanger 14 to slide or expand in relation to first heat exchanger 12 and thus release thermal stress.

What is claimed is:

1. A heat exchanger assembly comprising:

a first heat exchanger;

a mount attached to said first heat exchanger;

a second heat exchanger;

a bracket attached to said second heat exchanger, said bracket engaging said mount to attach said second heat exchanger to said first heat exchanger; wherein said bracket is freely inserted into said mount when said second heat exchanger is at an acute angle with respect to said first heat exchanger, said bracket having an interference fit with said mount when said second heat exchanger is parallel with said first heat exchanger, wherein said mount comprises:

a first upright extending from said first heat exchanger in a height direction of said mount;

a second upright extending from said first heat exchanger in the height direction;

a lower retaining wall extending between said first and second uprights in a length direction of said mount generally perpendicular to the height direction; and an upper retaining wall extending between said first and second uprights in the length direction; wherein a gap in a width direction of said mount is defined between said lower retaining wall and said upper retaining wall, the width direction being generally perpendicular to both the height direction and the length direction, an opening in the height direction of said first and second uprights is defined between said lower retaining wall and said upper retaining wall, the upper retaining wall is immovably fixed to the first and the second upright to keep the gap and the opening relative to the lower retaining wall, there is no overlap between the lower retaining wall and the upper retaining wall in the width direction of the mount, there is no overlap between the lower retaining wall and the upper retaining wall in the height direction of the mount, and wherein said mount further comprises an insertion slot defined by the gap and the opening, which accepts the bracket by tilting the second heat exchanger at the acute angle with respect to the first heat exchanger, and the second heat exchanger is moved into its installed position parallel with the first heat exchanger to create the interference fit between the bracket and the mount.

2. The heat exchanger assembly according to claim 1, wherein said first heat exchanger comprises a plurality of tubes extending between a pair of tanks, said mount being attached to one of said tanks of said first heat exchanger.

3. The heat exchanger assembly according to claim 2, wherein said second heat exchanger comprises a plurality of tubes extending between a pair of tanks, said bracket being attached to one of said tanks of said second heat exchanger.

4. The heat exchanger assembly according to claim 1, wherein said second heat exchanger comprises a plurality of tubes extending between a pair of tanks, said bracket being attached to one of said tanks of said second heat exchanger.

5. The heat exchanger assembly according to claim 1, wherein said upper retaining wall defines at least one rib extending toward said lower retaining wall.

6. The heat exchanger assembly according to claim 1 wherein said bracket has a rectangular shape.

7. The heat exchanger assembly according to claim 1, wherein said mount is integral with said first heat exchanger and said bracket is integral with said second heat exchanger.

8. The heat exchanger assembly according to claim 1, wherein the first heat exchanger comprises a plurality of first tubes disposed between a first and a second tank;

the mount is attached to said first tank;

the second heat exchanger comprises a plurality of second tubes disposed between a third and a fourth tank;

the bracket is attached to said third tank, and wherein the heat exchanger assembly further comprises an attachment assembly configured to attach the second tank and the fourth tank.

9. The heat exchanger assembly according to claim 8, wherein the attachment assembly comprises a female threaded retainer and a bolt.

10. A heat exchanger assembly comprising:

a first heat exchanger having a plurality of first tubes disposed between a first and a second tank;

a pair of mounts attached to said first tank;

a second heat exchanger having a plurality of second tubes disposed between a third and a fourth tank;

a pair of brackets attached to said third tank, each of said brackets being freely inserted into a respective mount when said second heat exchanger is at an acute angle with respect to said first heat exchanger, each of said brackets having an interference fit with said respective mount when said second heat exchanger is parallel with said first heat exchanger, wherein each of said mounts comprises:

a first upright extending from said first tank in a height direction of the mount;

a second upright extending from said first tank in the height direction;

a lower retaining wall extending between said first and second uprights in a length direction of the mount generally perpendicular to the height direction; and an upper retaining wall extending between said first and second uprights in the length direction; wherein a gap in a width direction of said mount is defined between said lower retaining wall and said upper retaining wall, the width direction being generally perpendicular to both the height direction and the length direction, an opening in the height direction of said first and second uprights is defined between said lower retaining wall and said upper retaining wall, the upper retaining wall is immovably fixed to the first and the second upright to keep the gap and the opening relative to the lower retaining wall, there is no overlap between the lower retaining wall and the upper retaining wall in the width direction of the mount, there is no overlap between the lower retaining wall and the upper retaining wall in the height direction of the mount, and wherein each of said mounts further comprises an insertion slot defined by the gap and the opening, which accepts the bracket by tilting the second heat exchanger at the acute angle with respect to the first heat exchanger, and the second heat exchanger is moved into its installed position parallel with the first heat exchanger to create the interference fit between the bracket and the mount.

11. The heat exchanger assembly according to claim 10, wherein said upper retaining wall defines at least one rib extending toward said lower retaining wall.

12. The heat exchanger assembly according to claim 10 wherein said bracket has a rectangular shape.

13. The heat exchanger assembly according to claim 10, wherein each of said mounts is integral with said first tank and each of said brackets is integral with said third tank.

14. The heat exchanger assembly according to claim 1, wherein the first upright and the second upright extend perpendicular to the first heat exchanger.

15. The heat exchanger assembly according to claim 14, wherein the lower retaining wall is an L-shaped wall comprising an upright portion extending perpendicular to a surface of the first heat exchanger, and a retaining portion which extends perpendicular to the upright portion.

16. The heat exchanger assembly according to claim 10, wherein the first upright and the second upright extend perpendicular to the first heat exchanger.

17. The heat exchanger assembly according to claim 16, wherein the lower retaining wall is an L-shaped wall comprising an upright portion extending perpendicular to a surface of the first heat exchanger, and a retaining portion which extends perpendicular to the upright portion.

18. The heat exchanger assembly according to claim 10, wherein the heat exchanger assembly further comprises a pair of attachment assemblies configured to attach the second tank and the fourth tank.

19. The heat exchanger assembly according to claim 18, wherein the pair of attachment assemblies comprises a female threaded retainer and a bolt.

* * * * *